US007150166B2

(12) United States Patent
Braun et al.

(10) Patent No.: US 7,150,166 B2
(45) Date of Patent: Dec. 19, 2006

(54) GAP COVER DEVICE FOR SIDE-BY-SIDE APPLIANCES

(75) Inventors: John T. Braun, Vernon Hills, IL (US); Thomas M. Asher, Racine, WI (US)

(73) Assignee: Any Tech, Inc., Buffalo Grove, IL (US)

( * ) Notice: Subject to any disclaimer, the term of this patent is extended or adjusted under 35 U.S.C. 154(b) by 0 days.

(21) Appl. No.: 11/163,491

(22) Filed: Oct. 20, 2005

(65) Prior Publication Data

US 2006/0086158 A1 Apr. 27, 2006

Related U.S. Application Data

(63) Continuation-in-part of application No. 10/973,213, filed on Oct. 26, 2004.

(51) Int. Cl.
*D06F 39/00* (2006.01)

(52) U.S. Cl. ..... 68/3 R; 68/235 R; 134/210

(58) Field of Classification Search ..... 68/3 R, 68/235 R; 298/166; 277/189; 108/27
See application file for complete search history.

(56) References Cited

U.S. PATENT DOCUMENTS 2,429,455 A * 10/1947 Dellon ..... 4/640
2,580,927 A * 1/1952 Bertrand et al. ..... 126/37 R
2,599,322 A * 6/1952 Drain ..... 52/278
2,705,820 A * 4/1955 Torrence ..... 52/782.2
2,722,689 A * 11/1955 Uphues ..... 4/631
2,778,032 A * 1/1957 Meehan ..... 4/636
2,820,229 A * 1/1958 Opstad ..... 4/660
2,888,684 A * 6/1959 Icenhower ..... 52/716.1
3,154,357 A * 10/1964 Urbank et al. ..... 312/111
3,169,518 A * 2/1965 Scott ..... 126/39 R
3,267,492 A * 8/1966 Jenkins ..... 4/660
3,352,615 A * 11/1967 Sandin ..... 312/111
3,376,861 A * 4/1968 Bach, Jr. ..... 126/37 R
3,392,720 A * 7/1968 Sherman ..... 126/211
3,446,201 A * 5/1969 More ..... 126/39 R
3,822,858 A * 7/1974 Franklin ..... 249/194
3,837,134 A * 9/1974 DiFazio ..... 52/784.13
4,243,016 A * 1/1981 Kristen et al. ..... 126/211
5,437,492 A * 8/1995 Pascoe ..... 296/166
5,516,185 A * 5/1996 O'Donnell et al. ..... 296/166
5,518,309 A * 5/1996 St-Pierre ..... 312/140.4
5,678,380 A * 10/1997 Azzar ..... 52/716.4
5,916,394 A * 6/1999 Prochaska et al. ..... 156/83
2002/0170553 A1* 11/2002 Grady ..... 126/220
2004/0129183 A1* 7/2004 Owen ..... 108/27

OTHER PUBLICATIONS

"Sky Mall" Brochure/ "Counter Kleen Seam Trim Kit" 2003.*

* cited by examiner

*Primary Examiner*—Frankie L. Stinson
(74) *Attorney, Agent, or Firm*—Levenfeld Pearlstein, LLC

(57) ABSTRACT

A gap cover device for covering a gap between clothes washer and dryer appliances having generally parallel juxtaposed sidewalls defining a gap between the appliances. The gap cover device includes a flexible elongated member having a generally T-shaped transverse cross-sectional configuration defining a gap spanning portion of sufficient transverse width to span the gap between the appliances, and an insert arm portion disposed generally normal to an underside of the gap spanning portion and adapted to be inserted into the gap. The insert arm portion has outwardly facing side surfaces at least one of which has a magnetic strip carried thereon operative to releasably secure the gap cover device to a selected one of the appliances to prevent objects from falling into the gap.

5 Claims, 2 Drawing Sheets

GAP COVER DEVICE FOR SIDE-BY-SIDE APPLIANCES

CROSS REFERENCE TO RELATED APPLICATION DATA

The present application is a continuation-in-part of U.S. patent application Ser. No. 10/973,213, filed Oct. 26, 2004.

BACKGROUND OF THE INVENTION

The present invention relates generally to devices for closing a gap between adjacent spaced objects, such as juxtaposed clothes washer and dryer appliances, and more particularly to an inexpensive device for releasable mounting between such juxtaposed but spaced appliances to prevent articles from falling into a gap between the appliances.

It is a common practice in both home laundry facilities and commercial coin-op laundries to place a clothes washer appliance in juxtaposed or relatively close side-by-side relation with a dryer appliance, as is typical in home laundry facilities, or position clothes washers and/or dryers in rows of juxtaposed washers or dryers as typical in commercial coin-op facilities. In either case, the juxtaposed washer and dryer appliances are generally spaced apart sufficiently to enable articles of clothing or other objects to fall into a gap between the juxtaposed appliances, thereby requiring retrieval and often re-washing if damp clothes become soiled by being inadvertently dropped into the gap during transfer from the washer to the dryer. This problem is made more severe when a washer is positioned on a tray-like pad adapted to catch water that might leak out of the washer. The periphery of the tray pad usually extends outwardly from the periphery of the washer sidewalls thereby causing a larger than normal space or gap to be created between the juxtaposed appliances into which objects may drop. Accordingly, an inexpensive device adapted to be readily inserted between spaced juxtaposed appliances, such as clothes washers and dryers, at their upper surface levels so as to cover the gap created therebetween would overcome the aforedescribed problems.

BRIEF SUMMARY OF THE INVENTION

An inexpensive gap cover is readily placed on and between juxtaposed objects, such as clothes washer and dryer appliances, so as to cover a gap between the appliances and prevent objects from falling into the gap.

The gap closer device is inserted into a gap created between spaced juxtaposed major appliances, such as a clothes washer and dryer pair, the gap closer device having a generally T-shaped transverse cross-section defining an elongated top cover member operative to span the gap and engage juxtaposed upper surfaces of the appliances, and having a depending arm for insertion into the gap to limit lateral movement of the gap closer device.

A feature of the gap closer device in accordance with the invention lies in providing magnetic means on at least one exposed surface of the depending arm for releasably adhering to an adjacent appliance so as to retain the gap closer device in relatively fixed position when closing a gap between a pair of appliances.

Another feature of the gap closer device in accordance with the present invention is the ability to make the device by extrusion techniques, preferably of a flexible polyvinyl chloride, with the result that a strong yet flexible elongated gap closure can be achieved economically.

In one embodiment, the insert arm portion has a connecting portion for connecting to the gap spanning portion, an intermediate portion and a free end, and the intermediate portion is more flexible than the gap spanning portion and the free end.

Further objects, features and advantages of the invention will become apparent from the following detailed description when taken in conjunction with the accompanying drawings wherein like reference numerals designate like elements throughout the several views. While the present invention is susceptible of various modifications and alternative forms, specific embodiments thereof are shown by way of example in the drawings and will herein be described in detail. It should be understood, however, that the drawings and detailed description are not intended to limit the invention to the particular form disclosed, but rather are intended to cover all modifications, equivalents and alternatives falling with the spirit and scope of the invention.

DETAILED DESCRIPTION OF THE INVENTION

Figure 1:
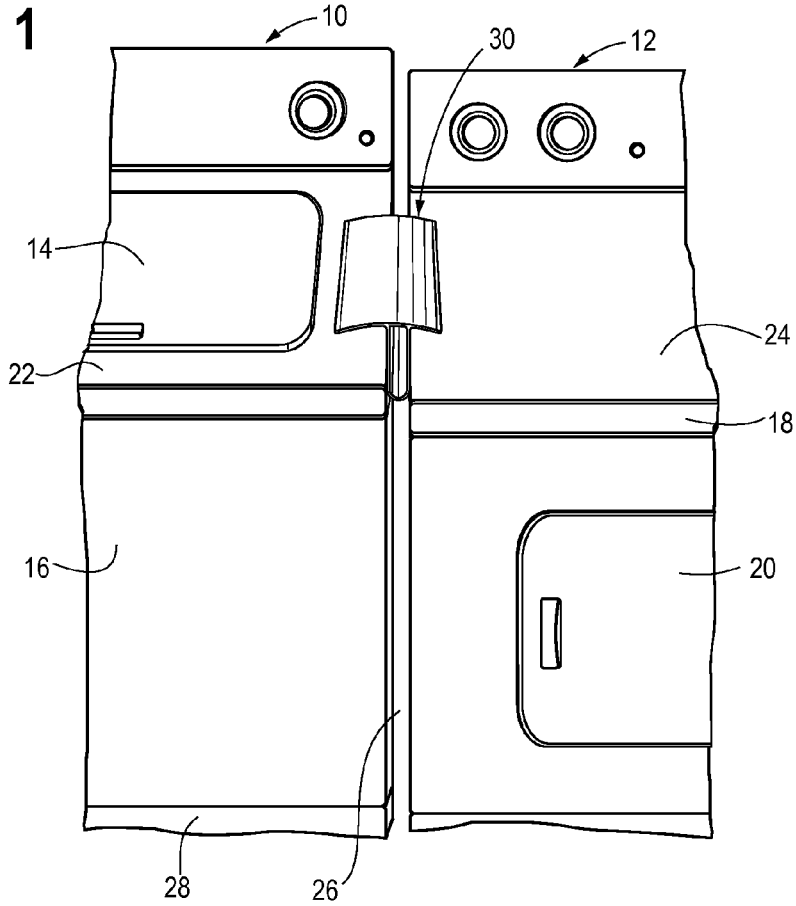
FIG. 1 is a fragmentary perspective view illustrating portions of clothes washer and dryer appliances disposed in juxtaposed spaced relation so as to create a gap therebetween, and having a gap closer device in accordance with the present invention closing the gap so as to prevent objects from falling into the gap.

Referring now to the drawings, and in particular to FIG. 1, a fragmentary portion of a clothes washer appliance of the type generally used in home laundry facilities is indicated generally at 10. The clothes washer appliance 10 is positioned in juxtaposed or side-by-side relation with a clothes dryer appliance, a fragmentary portion of which is indicated generally at 12, that is also of the type conventionally utilized in home laundry facilities. The clothes washer 10 has a hinged top loading access lid or door 14 and a generally rectangular housing including a vertically disposed front wall or panel 16 formed integral with otherwise suitably secured at its vertical marginal edges to sidewall panels as is known. Similarly, the clothes dryer 12 has a generally rectangular housing including a vertical front panel 18 to which a front access door 20 is hinged to facilitate insertion of damp or washed clothing into the dryer from the washer. Clothes washer and dryer appliances are generally of equal height so that their upper rectangular planar surfaces, indicated at 22 and 24, respectively, are substantially coplanar and have marginal edges disposed in juxtaposed or side-by-side relation.

As aforedescribed, it is a conventional practice in both home laundry facilities and commercial coin-op clothes washer and dryer facilities to place a pair of washer and dryer appliances in juxtaposed or relatively close side-by-side relation, or in a row of dryers or washers as frequently the case in commercial do-it-yourself coin-op laundries. Because during operation, both the washer and dryer may be subjected to vibration, it is a common practice to space the appliances so that a gap 26 is formed between the juxtaposed appliances of sufficient width to prevent the appliances from rubbing or engaging each other during operation.

It is also frequently desirable to position the washer on a rectangular tray-like base, as indicated at 28 in FIG. 1, so as to catch any water that may leak from the washer. As a result, an upstanding peripheral lip or marginal edge on the tray/base generally extends outwardly from the periphery of the washer sidewalls. This necessitates that the washer and dryer appliances be spaced farther apart more than might otherwise be the case in order to accommodate the tray-like base or pan 28. As a result, the gap 26 formed between the juxtaposed washer and dryer appliances is generally of sufficient width that objects may be inadvertently be dropped into the gap with the result that the objects must be retrieved. This is particularly troublesome when clothes items are dropped into the gap while being transferred from the washer to the dryer inasmuch as any clothing or the like dropped into the gap may become soiled and thereby necessitate re-washing.

Figure 2:
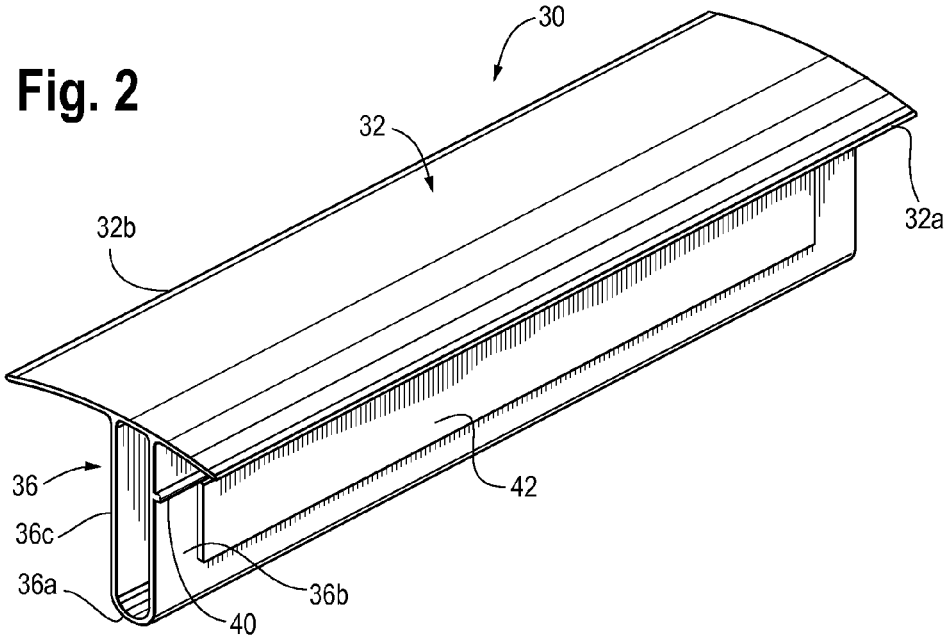
FIG. 2 is a perspective view of the gap closer device of FIG. 1.
Figure 3:
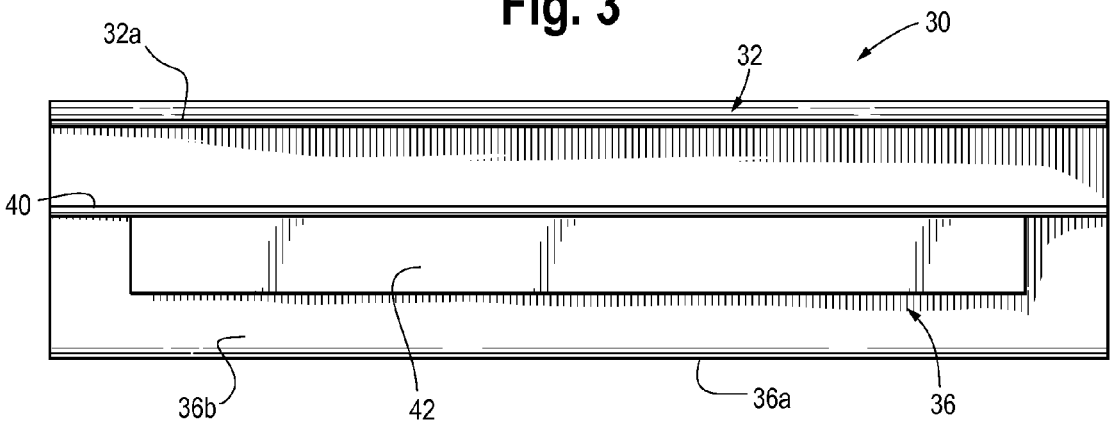
FIG. 3 is a side elevational view of the gap closer device of FIG. 2.
Figure 4:
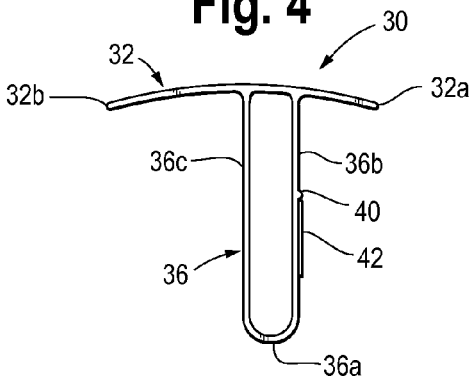
FIG. 4 is an end elevational of the gap closer device of FIG. 2.

In accordance with the present invention, a gap cover device, one embodiment of which is indicated generally at 30 in FIGS. 2–4, is provided to close the gap 26 between juxtaposed or spaced side-by-side appliances, such as the washer 10 and dryer 12. As illustrated in FIG. 1, the gap closer device 30 is adapted to be inserted into the gap 26 formed between the washer and dryer so as to span the gap and prevent objects from being inadvertently dropped into the gap.

The gap cover device 20 is formed as a flexibly elongated member having a generally T-shaped transverse cross-sectional configuration as shown in FIG. 4. The gap cover device 30, which may be termed a gap cover, has a gap spanning portion 32 that is of generally rectangular configuration as viewed in plan, and has a generally arcuate configuration when viewed in transverse section or in end elevation as in FIG. 4. The gap spanning portion 32 thereby defines a convex upper surface that may have a predetermined radius and extends between longitudinal laterally spaced marginal edges 32*a* and 32*b*. The gap spanning portion 32 has a transverse width, considered as the distance between the longitudinal marginal edges 32*a,b*, sufficient to enable the longitudinal marginal edges to engage the upper generally horizontal surfaces 22 and 24 of the washer and dryer appliances as illustrated in FIG. 1. To this end, the transverse width of the gap spanning portion 32 is preferably made of sufficient transverse width to cover a gap width or space of upwards of approximately 3.5".

The gap closer device 30 includes an insert arm portion 36 that is preferably formed integral with or otherwise suitably secured to the underside of the gap spanning portion 32 so as to extend downwardly therefrom in generally normal relation to a plane contacting the longitudinal marginal edges 32*a* and 32*b* of the span closing portion. As illustrated in FIG. 4, the insert arm portion 36 depends from the gap spanning portion 32 at a position laterally offset from the longitudinal center of the gap spanning portion. The insert arm portion 36 preferably extends downwardly from the gap spanning portion 32 a distance of at least approximately 3", and has a transverse width of approximately 0.75". The lower end of the insert arm 36 is preferably rounded at 36*a*.

In accordance with one feature of the gap closer device 30, it can be formed by conventional extrusion techniques and is preferably formed of a somewhat rigid polyvinyl chloride (PVC). In this manner, the insert arm portion 36 may be formed as a hollow arm portion having parallel sidewalls 36*b* and 36*c* the upper marginal edges of which are formed integral with the gap spanning portion 32, and the lower marginal edges of which are formed integral with the curved lower end 36*a*. It will be understood that the gap closer device 30 may also be formed from other suitable polymeric materials or PET.

A selected one of the insert arm walls 36*b* or 36*c*, preferably wall 36*b*, has a longitudinally extending bead or outward projection 40 formed thereon, such as during an extrusion process, so that the bead extends the length of the gap closer device preferably approximately mid-height of wall 36*b*. An elongated generally rectangular adhesive backed magnetic strip 42 is secured to the exterior surface of the insert arm wall 36*b* so that an upper marginal edge of the magnetic strip abuts or is spaced slightly below the longitudinal bead or projection 40 on the insert arm portion 36. The magnetic strip 42 may be formed as a continuous strip extending substantially the length of the gap closer device 30 or may be formed as a number of shorter length magnetic strips.

It will be appreciated that the gap closer device 30 may be mounted between the clothes washer and dryer appliances 10 and 12 so that the insert arm portion 36 extends into the gap 26, and the gap spanning portion 32 spans or covers the gap with the longitudinal marginal edges 32*a* and 32*b* of the gap spanning portion engaging the upper surfaces 22 and 24 of the juxtaposed washer and dryer. When so installed, the magnetic strip 42 magnetically adheres to an opposed upstanding sidewall of either the washer or dryer, depending on the orientation of the gap closing device when inserted into the gap, so as to maintain the gap closer device within the gap irrespective of vibration of the appliance to which it is magnetically attached.

Figure 5:
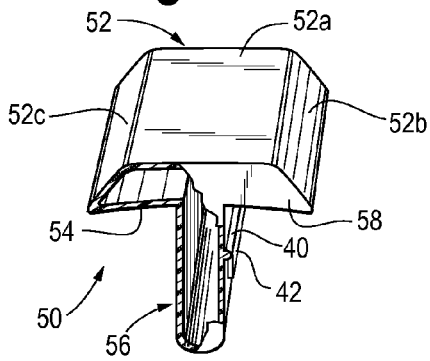
FIG. 5 is a perspective view illustrating an alternative embodiment of a gap closer device in accordance with the present invention.

FIG. 5 illustrates an alternative embodiment of a gap closer device, indicated generally at 50, that is generally similar to the aforedescribed gap closer device 30. The gap closer device 50 may be also be made of an extruded flexible plastic, such as flexible polyvinyl chloride, to define a gap spanning portion 52 having a generally flat upper surface 52*a* with longitudinal marginal edges formed integral with generally convexly curved outer longitudinal surface portions 52*b* and 52*c*. The outer marginal edges 52*b,c* are formed integral with a generally planar wall portion 54 to which an insert arm 56 is formed during an extruding process so that the gap closer device 50 is formed as an elongated flexible generally hollow and lightweight gap closer device with the gap spanning portion 52 operative to overlie and close a gap, such as 26, formed between two juxtaposed but spaced appliances and with the depending leg portion 56 extending into the gap. The depending leg portion has a similar elongated adhesively secured magnetic strip 42 applied to a selected one of the outer exposed surfaces of the arm insert adjacent a longitudinal extending bead or projection 58 similar to bead 40 on the gap closer device 30. Generally T-shaped end plates or covers, one of which is indicated at 58 in FIG. 5, may be applied to the opposite ends of the hollow gap closer device 50. If desired, the gap closer device 50 could be formed as a flexible solid extruded plastic gap closer.

Figure 6:
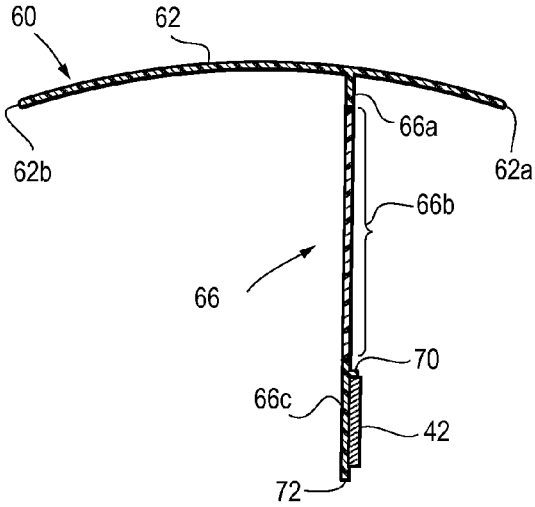
FIG. 6 is a cross-sectional view of an alternate embodiment of the gap closed device.

Still another embodiment of the gap closer or cover 60 is illustrated in FIG. 6. In this embodiment, much like the embodiment of the closer 30 in FIGS. 1–4, the gap spanning portion 62 is of generally rectangular configuration as viewed in plan, and has a generally arcuate configuration when viewed in transverse section or in end elevation and thus defines a convex upper surface that may have a predetermined radius, The spanning portion 62 has a transverse width, considered as the distance between the longitudinal marginal edges 62*a*, 62*b* that is sufficient to enable the longitudinal marginal edges to engage the upper generally horizontal surfaces 22 and 24 of the washer 10 and dryer 12 appliances as illustrated in FIG. 1.

In this embodiment, the insert arm portion 66 is a single depending arm that depends from the spanning portion 62. In a present embodiment, at least a portion 66*b* of the arm 66 is formed from a material having different physical properties (and possibly chemical properties) than the spanning portion 62 and perhaps other portion 66*a*, 66*c* of the arm 66. The arm 66 includes a connecting portion 66*a* (that is, the portion that is "connecting to" the spanning portion 62), an intermediate portion 66*b* and a terminal portion 66*c*. A longitudinal bead 70 is formed in the terminal portion 66*c*. A magnetic strip 42 is disposed on the terminal portion 66*c* between the bead 70 and a free end 72 of the arm 66. The magnetic strip 42 is configured to secure the closer 60 to one of the appliances 10, 12.

To facilitate packaging and to assure that the closer 60 stays affixed to the appliance 10 or 12, the intermediate portion 66*b* of the arm 66 is formed from a flexible material, while the spanning portion 62, connecting portion 66*a* and the terminal portion 66*c* are formed from a relatively rigid material. In this manner, the arm 66 can be folded or bent at the intermediate portion 66*b* to, for example, facilitate packaging and to allow the closer 60 to flex, for example, to accommodate the appliances 10, 12 as they vibrate and move during use.

In a present closer 60, the spanning portion 62, connecting portion 66*a* and the terminal portion 66*c* are formed from a rigid polyvinyl chloride (PVC) and the flexible portion 66*b* is formed from flexible PCV. In this manner, it is anticipated that the closer 60 can be extruded in a single operation (a coextrusion operation) so as to maintain costs reasonable and manufacture relatively easy. Other materials, as well as other fabrication methods and techniques will be recognized by those skilled in the art.

Having described various embodiments of a gap closer device in accordance with the present invention, it will be appreciated that an economical and lightweight gap closer device is provided that may be readily inserted into a gap between appliances so as to close or cover the gap between the appliances and thus prevent inadvertent dropping of objects into the gap. While preferred embodiments of the invention have been illustrated and described, it will be understood that the changes and modifications may be made therein without departing from the invention in its broader aspects. Various features of the invention are defined in the following claims.

What is claimed is:

1. A gap cover device for use in covering a gap between two appliances having generally parallel juxtaposed edges lying in a generally horizontal plane and defining a gap between the juxtaposed edges, the gap cover device comprising a relatively rigid elongated member having a substantially T-shaped transverse cross-sectional configuration defining a gap spanning portion of sufficient transverse width to engage the juxtaposed edges and span the gap therebetween, and an insert arm portion disposed generally normal to an underside of the gap spanning portion and adapted to be inserted into the gap, the insert arm portion defining outwardly facing side surfaces at least one of which has a magnetic strip carried thereon operative to releasably secure the cover device in position covering the gap so as to prevent objects from falling into the gap, the insert ann portion having a connecting portion for connecting to the gap spanning portion, an intermediate portion and a free end, and wherein the intermediate portion is more flexible than the gap spanning portion, wherein the insert arm includes a longitudinal outwardly extending bead formed thereon.

2. The gap cover device as defined in claim 1 wherein the intermediate portion is more flexible than the connecting portion and the free end of the insert arm.

3. The gap cover device as defined in claim 2 wherein the cover device is made of polyvinyl chloride and wherein the gap spanning portion, connecting portion and free end are formed from a relatively rigid polyvinyl chloride and the intermediate portion is formed from a flexible polyvinyl chloride.

4. The gap cover device as defined in claim 1 wherein the bead substantially divides the intermediate portion from the free end.

5. The gap cover device as defined in claim 4 wherein the magnetic strip is disposed on the free end adjacent the bead.

* * * * *